US007744742B2

(12) United States Patent
O'Rear

(10) Patent No.: US 7,744,742 B2
(45) Date of Patent: Jun. 29, 2010

(54) INTEGRATION OF MOLECULAR REDISTRIBUTION AND HYDROISOMERIZATION PROCESSES FOR THE PRODUCTION OF PARAFFINIC BASE OIL

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 405 days.

(21) Appl. No.: 11/987,207

(22) Filed: Nov. 28, 2007

(65) Prior Publication Data

US 2009/0137854 A1 May 28, 2009

(51) Int. Cl.
*C07C 5/00* (2006.01)

(52) U.S. Cl. ..... 208/18; 208/49; 208/62; 208/64; 208/65; 208/133; 208/134; 585/310; 585/317; 585/331

(58) Field of Classification Search ..... 208/18, 208/49, 62–65; 585/20, 23–24, 310, 317, 585/331–332, 350, 377–378, 446, 450
See application file for complete search history.

(56) References Cited

U.S. PATENT DOCUMENTS

| | | | |
|---|---|---|---|
| 3,699,035 | A | 10/1972 | Hughes et al. |
| 3,718,576 | A | 2/1973 | Hughes et al. |
| 3,728,410 | A | 4/1973 | Hughes |
| 3,775,505 | A | 11/1973 | Hughes |
| 3,784,622 | A | 1/1974 | Hughes |
| 3,793,251 | A | 2/1974 | Hughes |
| 3,808,285 | A | 4/1974 | Hughes |
| 3,856,876 | A | 12/1974 | Burnett |
| 3,864,417 | A | 2/1975 | Hughes |
| 3,914,330 | A | 10/1975 | Hughes |

(Continued)

FOREIGN PATENT DOCUMENTS

| | | |
|---|---|---|
| EP | 1741767 A1 | 1/2007 |

OTHER PUBLICATIONS

Robert L. Burnett and Thomas R. Hughes, "Mechanism and Poisoning of the Molecular Redistribution of Alkanes with a Dual-Functional Catalyst System," Journal of Catalysis 31, 55-64 (1973).

(Continued)

*Primary Examiner*—Robert J Hill, Jr.
*Assistant Examiner*—Brian McCaig
(74) *Attorney, Agent, or Firm*—Merchant & Gould PC

(57) ABSTRACT

The process as described herein produces a moderately aromatic isoparaffinic base oil from a distillate range product. This process comprises: (a) providing a distillate range paraffin feed comprising paraffins and cycloparaffins; (b) mildly reforming the distillate range paraffin feed to convert at least a portion of the cycloparaffins to alkylaromatics and provide a mildly reformed distillate range stream; (c) treating a stream comprising the mildly reformed distillate range stream in a molecular redistribution reactor to provide a distributed stream; (d) dewaxing at least a portion of the distributed stream to provide a dewaxed stream; (e) combining at least a portion of the dewaxed stream with the stream to be processed in the molecular redistribution reactor to provide the distributed stream; and (f) isolating a moderately aromatic isoparaffinic base oil from the dewaxed stream. According to another aspect, the process generates low ring content isoparaffinic base oil by hydrotreating the moderately aromatic isoparaffinic base oil.

25 Claims, 7 Drawing Sheets

U.S. PATENT DOCUMENTS

| | | | |
|---|---|---|---|
| 4,507,517 | A | 3/1985 | DeVries et al. |
| 4,599,474 | A | 7/1986 | DeVries et al. |
| 4,704,487 | A | 11/1987 | DeVries et al. |
| 4,704,493 | A | 11/1987 | DeVries et al. |
| 4,709,108 | A | 11/1987 | DeVries et al. |
| 4,734,537 | A | 3/1988 | DeVries et al. |
| 4,814,533 | A | 3/1989 | DeVries et al. |
| 4,814,534 | A | 3/1989 | DeVries et al. |
| 4,814,538 | A | 3/1989 | DeVries et al. |
| 6,225,359 | B1 | 5/2001 | O'Rear et al. |
| 6,359,018 | B1 | 3/2002 | O'Rear et al. |
| 6,369,286 | B1 | 4/2002 | O'Rear et al. |
| 6,392,109 | B1 | 5/2002 | O'Rear et al. |
| 6,441,263 | B1 | 8/2002 | O'Rear et al. |
| 6,562,230 | B1 | 5/2003 | O'Rear et al. |
| 6,566,569 | B1 | 5/2003 | Chen et al. |
| 6,627,779 | B2 | 9/2003 | O'Rear et al. |
| 6,768,037 | B2 | 7/2004 | O'Rear et al. |
| 6,833,065 | B2 | 12/2004 | O'Rear et al. |
| 6,858,133 | B2 | 2/2005 | Dath et al. |
| 6,864,398 | B2 | 3/2005 | O'Rear et al. |
| 6,890,423 | B2 | 5/2005 | O'Rear et al. |
| 2007/0060781 | A1 | 3/2007 | Goldman et al. |

OTHER PUBLICATIONS

Thomas R. Hughes, Robert L. Burnett and Robert G. Wall, "Molecular Redistribution of Alkanes and Alkybenzenes" Proc. International Congress on Catalysis, 5th (Palm Beach, FL, Aug. 21-25) paper 87, 1217-1228 (1972).

Goldman et al., "Catalygic Alkane Metathesis by Tandem Alkane Dehydrogenation—Olefin Metathesis" Science, vol. 312, No. 5771, pp. 257-261, Apr. 14, 2006.

McPhee, A. "Upgrading kerosene to normal paraffins", Petrochemicals and Gas Processing Petroleum Technology Quarterly, pp. 127-131, (Winter 1999/2000).

Robert L. Burnett and Thomas R. Hughes, "Mechanism and Poisoning of the Molecular Redistribution of Alkanes with a Dual Functional Catalyst System," Journal of Catalysis 31, 55-54 (1973).

Thomas R. Hughes, Robert L. Burnett and Robert G. Wall, Proc. International Congress on Catalysis, 5th (Palm Beach, FL, Aug. 21-25) 1972 paper 87, 1217-1228.

INTEGRATION OF MOLECULAR REDISTRIBUTION AND HYDROISOMERIZATION PROCESSES FOR THE PRODUCTION OF PARAFFINIC BASE OIL

FIELD OF ART

The process as described herein relates to production of moderately aromatic isoparaffinic base oils and low ring content isoparaffinic base oils by means of a combination of mild reformation, molecular redistribution, and dewaxing processes.

BACKGROUND

Isoparaffinic base oils are useful as engine and industrial oils. There is a significant demand for them because they are superior to conventional base oils due to their better viscosity index, oxidation stability, evaporation losses, low temperature viscosity, metal staining, etc.

Low ring content isoparaffinic base oils are especially desirable because they contain only minor amounts of saturated ring carbon. Saturated ring carbon present in the base oils is detrimental as it lowers viscosity index and alters other characteristics of the base oils so that they are not as useful.

One type of isoparaffinic base oils are PolyAlphaOlefins (PAOs), which are made from the trimerization of 1-decene followed by hydrogenation. However, PAOs are expensive to manufacture because ethylene is used to produce the starting reagent, 1-decene. While PAOs are essentially free of saturated ring carbon as measured by the n-d-M method, PAOs are limited in application due to their cost. Any saturated ring carbon present is primarily naphthenic.

As an alternative route, petroleum-derived wax may be hydroisomerized to produce isoparaffinic base oils. But this process is not ideal because the starting petroleum-derived wax is often more valuable than the resulting isoparaffinic base oil. Furthermore, isoparaffinic base oils produced from petroleum-derived wax contain considerable amounts of saturated ring carbon unless the petroleum-derived wax is first subjected to deoiling, an expensive purification process.

More recently, it has been discovered that Fischer-Tropsch wax can be hydroisomerized to produce isoparaffinic base oils having low ring carbon content. Exploiting the Fischer-Tropsch process is beneficial because various hydrocarbonaceous assets are starting materials for the Fischer-Tropsch process and large quantities of Fischer-Tropsch wax are expected to be available, for example due to (1) conversion of remote natural gas into salable liquid products, (2) conversion of coal into liquid products, and (3) conversion of biomass into liquid products. However, this path to isoparaffinic base oils suffers from certain shortcomings. First, the percentage of wax in Fischer-Tropsch products rarely exceeds 50%; usually the percentage of wax is about 30%. Second, it produces low ring content isoparaffinic base oils with more low molecular weight, low viscosity isoparaffins than high molecular weight, high viscosity isoparaffins. This is due to the molecular weight distribution in Fischer-Tropsch wax, commonly referred to as the Schultz-Flory distribution. According to the Schultz-Flory distribution, the amount of Fischer-Tropsch product with a given carbon number decreases with increasing carbon number (e.g. there are always fewer $C_{10}$ products than $C_9$ products). Third, hydroisomerization of Fischer-Tropsch wax is not 100% selective and results in a distillate range paraffin by-product. Fourth, the number of Fischer-Tropsch processes might not be able to meet future demand for wax. Fifth, gaining a foothold in the lubricant market with a new base oil composition, such as one produced from Fischer-Tropsch wax, is extremely difficult.

The fit of low ring content isoparaffinic base oils with current products is also problematic. Isoparaffins necessarily impart certain desirable properties to the base oils, for example, high viscosity index and good oxidation stability. However, they can also impart unfavorable characteristics including inadequate additive solubility, inadequate engine deposit solubility, and improper seal shrink/hardening behavior.

Thus, an improved process of producing isoparaffinic base oils is needed. In such an improved process, first, it will be possible to adjust the molecular weight distribution of the isoparaffinic base oil in order to produce both low viscosity and high viscosity base oils. Second, there will be higher (ideally 100%) selectivity for low ring content isoparaffinic base oils rather than by-products, such as distillate range paraffins useful as components in jet and diesel fuel, because the base oils are generally more valuable than the by-products. Third, the starting material for the process will be available in sufficient amounts. Finally, the base oil composition produced by such an improved process will have the desired physical properties and be a composition already sold and well-known on the lubricant market.

SUMMARY

In its broadest aspect, the process as described herein produces a moderately aromatic isoparaffinic base oil from a distillate range product. This process comprises: (a) providing a distillate range paraffin feed comprising paraffins and cycloparaffins; (b) mildly reforming the distillate range paraffin feed to convert at least a portion of the cycloparaffins to alkylaromatics and provide a mildly reformed distillate range stream; (c) treating a stream comprising the mildly reformed distillate range stream in a molecular redistribution reactor to provide a distributed stream; (d) dewaxing at least a portion of the distributed stream to provide a dewaxed stream; (e) combining at least a portion of the dewaxed stream with the stream to be processed in the molecular redistribution reactor to provide the distributed stream; and (f) isolating a moderately aromatic isoparaffinic base oil from the dewaxed stream.

According to another aspect, the process generates low ring content isoparaffinic base oil by hydrotreating the moderately aromatic isoparaffinic base oil.

Among other factors, the process as described herein is useful because it utilizes either Fischer-Tropsch wax or another hydrocarbon source as a feedstock. Additionally, the process is valuable as it generates moderately aromatic isoparaffinic base oils and low ring content isoparaffinic base oils with improved physical properties (e.g. additive solubility, engine deposit solubility, and seal compatibility), as well as improved base oil yield. Moreover, the process is advantageous because it allows for adjustment of the molecular weight distribution of hydrocarbons in the base oil and eliminates problems associated with cycloparaffins in the molecular redistribution reaction.

DETAILED DESCRIPTION

Figure 1:
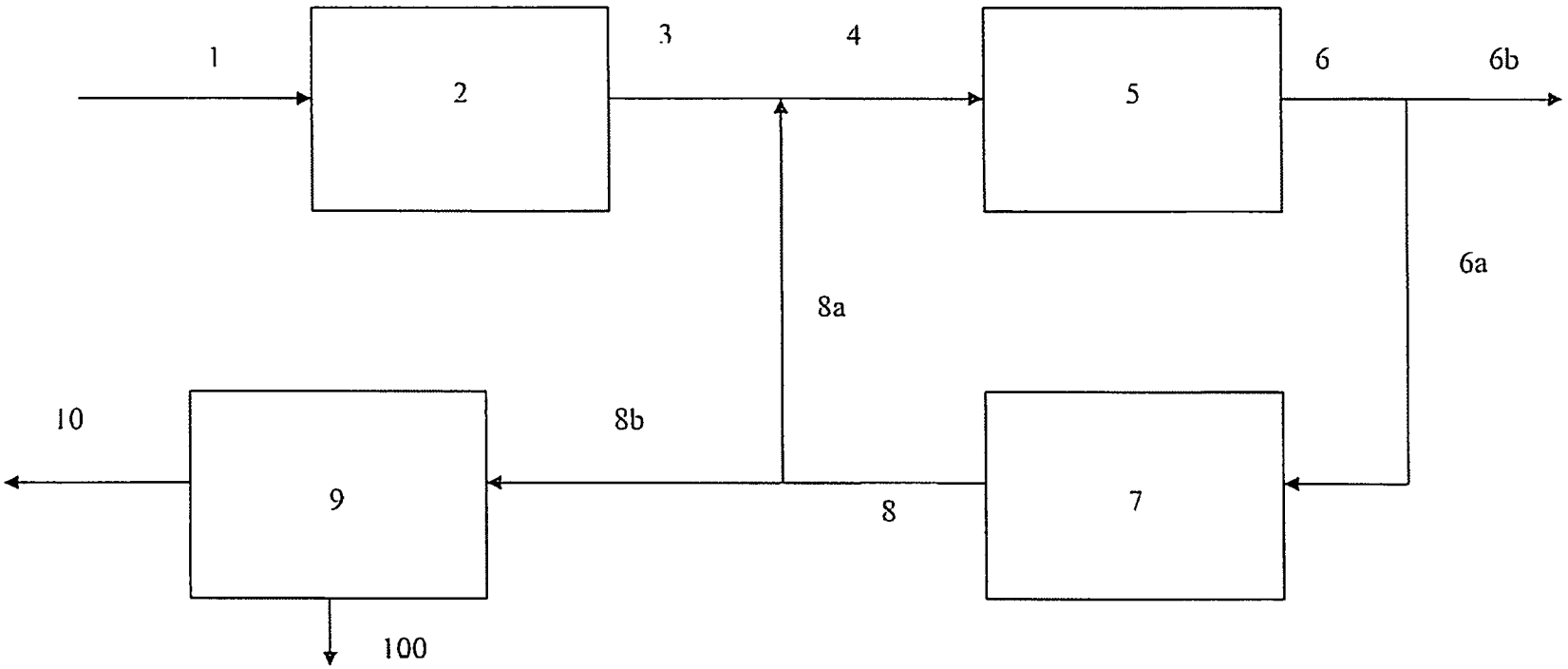
FIG. 1 is a schematic flow diagram representing a basic form of the process as described herein.

It has been discovered that integration of mild reforming, molecular redistributing, and dewaxing into a single process provides a novel and useful method of producing moderately aromatic isoparaffinic base oils and related low ring content isoparaffinic base oils. In its simplest form, which is schematically illustrated in FIG. 1, the process involves providing a distillate range paraffin feed as a feedstream to the process and subjecting the distillate range paraffin feed to a series of refining processes including mild reforming, molecular redistributing, and dewaxing. The distillate range paraffin feed comprises paraffins and cycloparaffins. The latter are undesirable components of the distillate range paraffin feed and are subsequently converted to more desirable components through the subsequent processing. Such conversion occurs in a mild reforming step whereby the distillate range paraffin feed is mildly reformed converting at least a portion of the cycloparaffins to alkylaromatics. The mild reforming provides a mildly reformed distillate range stream wherein at least a portion of the cycloparaffins are converted to alkylaromatics.

Higher levels of cycloparaffins are undesirable when refining hydrocarbons to produce isoparaffinic base oil because they can lessen the excellent physical properties associated with isoparaffinic base oils (especially when the cycloparaffins are multi-cycloparaffins) and can impede the molecular redistribution reaction. Therefore, the mild reforming step in the integrated process minimizes or otherwise controls the effects of cycloparaffins during the subsequent processing. Due to the ruinous effects of cycloparaffins during molecular redistribution, it is important that the mild reforming step takes place prior to the molecular redistribution step.

After the distillate range paraffin feed is mildly reformed to provide the mildly reformed distillate range stream, a stream comprising the mildly reformed distillate range stream is treated in a molecular redistribution reactor to provide a distributed stream. In the molecular redistribution reactor, one of two types of molecular redistribution takes place. Paraffins of two different molecular weight ranges can be mixed and converted into a molecular weight range centered around the molecular weight average of the two initial ranges. In this manner, intermediate paraffins can be made from light and heavy paraffins. Alternatively, paraffins of one narrow average molecular weight range can be converted into a broader distribution with the same average molecular weight. In this manner, desirable paraffins can be made from less desirable paraffins.

Next, at least a portion of the distributed stream is dewaxed to provide a dewaxed stream. The portion of the distributed stream can be dewaxed either by catalytic or solvent dewaxing. In certain embodiments, the portion of the distributed stream can be both catalytically dewaxed and dewaxed in another manner. Dewaxing removes hydrocarbons from the distributed stream that solidify more readily (i.e. waxes) than other hydrocarbons making up the distributed stream. As a result, the dewaxed stream is substantially free from waxes.

In one embodiment, at least a portion of the dewaxed stream is combined into the stream to be processed in the molecular redistribution reactor. As such, at least a portion of the dewaxed stream is recycled to the molecular redistribution reactor. From the dewaxed stream that is not recycled, a moderately aromatic isoparaffinic base oil product is isolated.

Another embodiment of the process further comprises hydrotreating the moderately aromatic isoparaffinic base oil to provide a low ring content isoparaffinic base oil.

The present process is best understood with reference to FIG. 1. In FIG. 1, a distillate range paraffin feed 1 comprising paraffins and cycloparaffins enters a mild reformation unit 2 to convert at least a portion of the cycloparaffins to alkylaromatics and provide a mildly reformed distillate range stream 3. A stream 4 comprising the mildly reformed distillate range stream is then treated in a molecular redistribution reactor 5 to provide a distributed stream 6. At least a portion of the distributed stream 6*a* is split off from the distributed stream 6 leaving behind a remaining portion of the distributed stream 6*b*. The portion 6*a* is then dewaxed in a dewaxing unit 7 to provide a dewaxed stream 8. At least a portion of the dewaxed stream 8*a* is combined with the mildly reformed distillate range stream 3 to provide the stream to be processed in the molecular redistribution reactor 4. The remaining portion of the dewaxed stream 8*b* is sent to a separation unit 9 where a moderately aromatic isoparaffinic base oil product 10 is isolated from other components of the dewaxed stream 100.

Definitions

The following terms will be used throughout the specification and will have the following meanings unless otherwise indicated.

As used herein, the term "paraffin" means any saturated hydrocarbon compound, i.e., an alkane with the formula $C_nH_{2n+2}$ where n is a positive non-zero integer.

The term "alkyl" means a straight-chain or branched saturated monovalent hydrocarbon of one to forty carbon atoms that is a component of a larger molecule, e.g., methyl, ethyl, i-propyl, and the like. Alkyl groups have the formula $C_nH_{2n+1}$ where n is a positive non-zero integer.

The term "aromatic" means any hydrocarbonaceous compound that contains at least one group of atoms that share an uninterrupted cloud of delocalized electrons, where the number of delocalized electrons in the group of atoms corresponds to a solution to the Huckel rule of 4n+2 (e.g., n=1 for 6 electrons, etc.). Representative examples include, but are not limited to, benzene, biphenyl, naphthalene, and the like.

The term "alkylaromatic" means any compound that contains at least one aromatic ring with at least one attached alkyl group. This group includes, for example, alkylbenzenes, alkylnaphthalenes, alkyltetralines, and alkylpolynuclear aromatics.

The term "cycloparaffin" means any saturated cyclic hydrocarbon of the formula $C_nH_{2n}$ where n is a positive non-zero integer. n-Decylcyclohexane is an example of a cycloparaffins.

The term "cycloparaffinic" means any saturated monovalent cyclic hydrocarbon radical of three to eight ring carbons or any larger hydrocarbon radical substituted with such a cyclic hydrocarbon. This group includes, for example, cyclohexyl, cyclopentyl, decylcyclohexyl, and the like.

Naphthenic carbon refers to the portion of the carbon in saturated cyclic structures in an average molecule as defined by the normalized ndM method.

Aromatic carbon refers to the portion of the carbon in aromatic structures in an average molecule as defined by the normalized ndM method.

Paraffinic carbon refers to the portion of the carbon in paraffinic structures in an average molecule as defined by the normalized ndM method.

The term "base oil" means a hydrocarbon fluid having a kinematic viscosity at 100 degrees C between 1.5 and 74.9 $mm^2/s$. It is a hydrocarbon fluid to which other oils or substances are added to produce a lubricant.

The term "low ring content isoparaffinic base oil" refers to a base oil having an amount of naphthenic carbon between 1 and 10 weight percent, an olefin content of less than or equal to 2 weight percent, an aromatic carbon content of 0.1 weight percent or less, and the balance paraffinic carbon.

The term "moderately aromatic isoparaffinic base oil" refers to the product of processing a low ring content isoparaffinic base oil over a mild reforming catalyst. Examples of moderately aromatic isoparaffinic base oil have:

(i) an aromatic carbon content between 0.1 and 10 weight percent;

(ii) a naphthenic carbon content equal to or less than the aromatic carbon content;

(iii) an olefin content less than or equal to 2 weight percent; and (iv) a paraffinic carbon content as the remaining weight percent.

The term "hydrocarbonaceous asset" means materials comprising hydrogen, carbon, and optionally sulfur, nitrogen, oxygen, and other elements used to manufacture low ring content isoparaffinic base oil. Examples of hydrocarbonaceous assets are natural gas, methane, coal, petroleum, petroleum products and intermediate streams, tar sands, oils shale, shale oil, waste plastics, waste tires, municipal waste, derivatives thereof, and mixtures thereof.

The term "dewaxing" refers to a process by which the pour point of a lubricant is reduced. More specifically, it is the process of removing hydrocarbons that readily solidify (i.e. waxes) from the remaining hydrocarbons. There are two general categories of dewaxing: solvent dewaxing and catalytic dewaxing.

The term "hydroisomerization" refers to a process in which a normal paraffin is converted at least partially into an isoparaffin by the use of hydrogen and a catalyst. Hydroisomerization is one type of catalytic dewaxing.

The term "distillate range" refers to hydrocarbons typically found in jet, diesel, and distillate fuels. Examples of distillate range hydrocarbons are $C_6$ to $C_{40}$ hydrocarbons.

The term "distillate range paraffin" refers to a hydrocarbon mixture containing over 50% $C_6$ to $C_{40}$ paraffins. For example, the distillate range paraffin may contain 50-99% $C_6$ to $C_{40}$ paraffins, 75-98% $C_6$ to $C_{40}$ paraffins, or 80-90% $C_6$ to $C_{40}$ paraffins. Distillate range paraffins may contain heteroatoms (e.g. S, N, O), unsaturated species (e.g. olefins), and cycloparaffinic and aromatic compounds. Preferably any cycloparaffinic and aromatic compounds are in limited amounts. Exemplary ranges of limited amounts of cycloparaffinic and aromatic compounds are 0-20%, 0.1-10%, and 0.5-5%, respectively.

As used herein, the term "molecular redistribution" refers to all types of molecular redistribution, including molecular averaging. Molecular averaging is a particular type of molecular redistribution whereby two paraffin fractions, a paraffin fraction with an average molecular weight above a desired molecular weight and a paraffin fraction with an average molecular weight below the desired molecular weight, are converted into a single paraffin fraction having a wider carbon number distribution and an average molecular weight approximately equal to the desired molecular weight. Another type of molecular redistibution converts a single paraffin fraction into a paraffin fraction with a wider carbon number distribution.

The term "olefin" means any unsaturated hydrocarbon compound having at least one carbon-to-carbon double bond, i.e. an alkene with a chemical formula of $C_nH_{2n}$. Examples of olefins include ethylene, propylene, butene, and so on.

The term "distillation section" refers to a portion of the process that contains at least one distillation column and typical equipment such as pumps, heat exchangers, furnaces, instruments, valves and the like.

Feed

The distillate range paraffin feed is the feed to the integrated process as described herein. The distillate range paraffin feed includes hydrocarbons originating from any one or more hydrocarbon sources. For example, the distillate range paraffin feed may be derived from Fischer-Tropsch products, shale oil, or biological sources. The distillate range paraffin feed may also be petroleum-derived or derived from any combination of Fischer-Tropsch products, shale oil, biological sources, and petroleum.

The selection of the hydrocarbon sources to be used in the distillate range paraffin feed is dependent upon economics as certain hydrocarbon sources are more expensive than others. The distillate range paraffin feed may comprise a wide-range of hydrocarbon sources as a single hydrocarbon source. If the distillate range paraffin feed comprises a wide-range of hydrocarbons, high viscosity isoparaffinic base oil is produced. However, to produce this base oil product from a wide-range of hydrocarbons, a large amount of material must be recycled. More specifically, a large portion of the dewaxed stream must be sent back to the molecular redistribution reactor.

As set forth above, the distillate range paraffin feed contains paraffins, including cycloparaffins.

The distillate range paraffin feed may be hydrotreated prior to being subjected to the mild reforming step. Alternatively, if the distillate range paraffin feed is derived from Fischer-Tropsch products, the Fischer-Tropsch products may be hydrotreated prior to deriving the distillate range paraffin feed from the Fischer-Tropsch products.

Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated.

A particularly preferred source for the distillate range paraffin feed are Fischer-Tropsch products produced by a Fischer-Tropsch process.

Fischer-Tropsch Process

Preferably the distillate range paraffin feed comprises Fischer-Tropsch products made from a Fischer-Tropsch process. In Fischer-Tropsch chemistry, synthesis gas (syngas) is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. If ethane and heavier hydrocarbons are present, a pre-reformer known in the art is used to convert these hydrocarbons into methane and/or synthesis gas. Generally, syngas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason and depending on the quality of the syngas, it is preferred to remove sulfur and other contaminants from the feed before performing the Fischer-Tropsch chemistry. Means for removing these contaminants are well known to those of skill in the art. For example, ZnO guardbeds are preferred for removing sulfur impurities. Means for removing other contaminants are well known to those of skill in the art. It may also be desirable to purify the syngas prior to the Fischer Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer-Tropsch process, liquid and gaseous hydrocarbons are formed by contacting the syngas comprising a mixture of $H_2$ and CO with a Fischer-Tropsch catalyst under suitable temperature and pressure reactive conditions. The Fischer-Tropsch reaction is typically conducted at temperatures of about 300 to 700° F. (149 to 371° C.), for example about from 400 to 550° F. (204 to 228° C.); pressures of from about 10 to 600 psia (1.7 to 41 bars), for example 30 to 300 psia (2 to 21 bars) and catalyst space velocities of from about 100 to about 10,000 cc/g/hr, for example 300 to 3000 cc/g/hr.

Examples of conditions for performing Fischer-Tropsch type reactions are well known to those of skill in the art. Suitable conditions are described, for example, in U.S. Pat. Nos. 4,704,487; 4,507,517; 4,599,474; 4,704,493; 4.709,108; 4,734,537; 4,814,533; 4,814, 534; and 4,814,538, the contents of each of which are hereby incorporated by reference in their entirety.

The products of the Fischer-Tropsch synthesis process may range from $C_1$ to $C_{200+}$ with a majority in the $C_5$-$C_{100+}$ range. The reaction can be conducted in a variety of reactor types; for example, fixed bed reactors containing one or more catalyst beds, slurry reactors, fluidized bed reactors, or a combination of different type reactors. Such reaction processes and reactors are well known and documented in the literature.

In general, Fischer-Tropsch catalysts contain a Group VIII transition metal on a metal oxide support. The catalysts may also contain a noble metal promoter(s) and/or crystalline molecular sieves. Certain catalysts are known to provide chain growth probabilities that are relatively low to moderate, and the reaction products include a relatively high proportion of low molecular ($C_{2-8}$) weight olefins and a relatively low proportion of high molecular weight ($C_{30+}$) waxes. Certain other catalysts are known to provide relatively high chain growth probabilities, and the reaction products include a relatively low proportion of low molecular ($C_{2-8}$) weight olefins and a relatively high proportion of high molecular weight ($C_{30+}$) waxes. Such catalysts are well known to those of skill in the art and can be readily obtained and/or prepared.

Mild Reforming

Whether the distillate range paraffin feed comes from a Fischer-Tropsch process, the hydroprocessed product of a Fischer-Tropsch process, or another hydrocarbon source, the distillate range paraffin feed inevitably contains some amount of cycloparaffins. Cycloparaffins, especially saturated and partially saturated cyclic hydrocarbons, are unwanted because they tend to form hydrogen during the molecular redistribution step, which inhibits the molecular redistribution step and is counterproductive to the process. Alkylaromatics do not have the same effect on molecular redistribution and, therefore, are better tolerated in the process as described herein. Mildly reforming the distillate range paraffin feed converts at least a portion of the cycloparaffins to alkylaromatics.

If the cycloparaffins were not transformed into alkylaromatics, the cycloparaffins would have to be removed by some other means. While it is possible to remove cycloparaffins through extraction or hydrocracking as proposed in U.S. Pat. No. 6,562,230, which is incorporated herein by reference in its entirety, extraction and hydrocracking are not ideal. Extracting removes all types of paraffins, not just cycloparaffins, and fails to remove trace amounts of cycloparaffins. Hydrocracking converts a significant amount of paraffins to lighter products. The process as described herein is an improvement over the prior art because mild reforming does not suffer from any of these side effects.

Mild reformation of the distillate range paraffin feed is different from severe reformation of light hydrocarbons like the severe reformation utilized in U.S. Pat. Nos. 6,392,109; 6,627,779; 6,833,065; and 6,890,423, which documents are incorporated herein by reference in their entirety. Severe reformation converts significant amounts of paraffins into aromatics. In contrast, the mild reformation step of the present process is selective for cycloparaffins only.

Preferably the mild reformation step converts the cycloparaffins to alkyaromatics such that the amount of aromatic carbons present as alkylaromatics in the mildly reformed distillate range stream is no more than five (5) times the amount of saturated ring carbons present as cycloparaffins in the feed to be mildly reformed. For example, the percentage of aromatic carbons present as alkylaromatics may be equal to the percentage of saturated ring carbons present as cycloparaffins. As other examples, the percentage of aromatic carbons may be ½ or 1/10, respectively, of the percentage of saturated ring carbons. However, the percentage of aromatic carbons in the mildly reformed distillate range stream will always be greater than zero.

According to one embodiment of the process as described herein, the percentage of aromatic carbons present as alkylaromatics is equal to between 10% and 200% of the percentage of the saturated ring carbons present as cycloparaffins. In certain embodiments, the percentage of aromatic carbons present as alkylaromatics is equal to between 50% and 150% of the percentage of the saturated ring carbons present as cycloparaffins. In other embodiments, the percentage of aromatic carbons present as alkylaromatics is equal to between 90% and 110% of the percentage of the saturated ring carbons present as cycloparaffins.

The low, but non-zero, levels of aromatic carbon in the isoparaffinic base oil improves the physical properties of the base oil. Specifically, the aromatic carbon improves additive solubility, engine deposit solubility, and seal compatibility of the base oil. However, if less aromatic carbon is desired, the amount of aromatic carbon can be reduced by hydrotreating. There will also be low levels of aromatic carbon in any by-product distillate fuel produced by the current process. This aromatic carbon similarly improves the seal swell performance of the by-product distillate fuel.

Mild reformation generally involves a catalyst, which can be the same as the dehydrogenation/hydrogenation component of a severe reformation catalyst. Typical dehydrogenation/hydrogenation components in severe reformation and, therefore, typical mild reformation catalysts are group VIII metals such as platinum. While severe reformation catalysts usually include an acidic component, such as a halogen like chlorine or a zeolite, mild reformation catalysts do not contain significant quantities of acidic components and may include alkali materials to neutralize acidic components that are inadvertently present. Examples of alkali materials include, but are not limited to, lithium, sodium, potassium, rubidium, cesium, calcium, magnesium, strontium, and barium. The mild reformation catalyst also includes a support component, typically alumina. However, silica, all-silica molecular sieves, non-acidic crystalline alumina phosphates, carbons, and other essentially non-acidic supports can be used. An example of a mild reforming catalyst is platinum supported on lithium neutralized alumina. Preparation of this catalyst is described in Example 1 of U.S. Pat. No. 6,441,263, which is incorporated herein by reference in its entirety.

Molecular Redistribution

As stated above, after the distillate range paraffin feed is mildly reformed to produce the mildly reformed distillate range stream, a stream comprising the mildly reformed distillate range stream is treated in a molecular redistribution reactor. As the term molecular redistribution implies, molecular redistribution takes place inside the molecular redistribution reactor. There are two types of molecular redistribution.

The first type of molecular redistribution, which is commonly referred to as molecular averaging, denotes a process in which two paraffin fractions of different molecular weight ranges are converted to a single paraffin fraction with a larger carbon number distribution than either of the starting fractions and an average molecular weight between the starting fractions. More specifically, paraffins with a desired molecular weight are produced from a fraction of paraffins with an average molecular weight above the desired molecular weight and a fraction of paraffins with an average molecular weight below the desired molecular weight. By selecting a broad boiling range cut from the molecular redistribution reactor, paraffins with a wider range of carbon numbers than the starting paraffin fractions are obtained. For example, $C_5$ to $C_{10}$ paraffins may be subjected to molecular averaging with $C_{20}$ to $C_{25}$ paraffins to produce a $C_{5-}$ to $C_{20+}$ mixture which contains the desired net product of $C_{10}$ to $C_{20}$ paraffins. The starting $C_5$ to $C_{10}$ and $C_{20}$ to $C_{25}$ fractions have a narrower carbon number distribution than the carbon number distribution of the resulting product.

The ratio of the fraction with an average molecular weight above the desired molecular weight (i.e. relatively high molecular weight fraction) to the fraction with an average molecular weight below the desired molecular weight (i.e. relatively low molecular weight fraction) also determines the molecular weight of the molecular redistribution product. The average molecular weight of the two fractions, taking into consideration the relative proportions of each fraction, should be close to the desired average molecular weight.

The second type of molecular redistribution transforms a single paraffin fraction into a paraffin fraction with a wider carbon number distribution, but the same average molecular weight.

Accordingly, in the process as disclosed herein, the term "molecular redistribution" can refer to either type of molecular redistribution. Thus, either the first type of molecular redistribution or the second type of molecular redistribution can occur in the molecular redistribution reactor, depending on the feed to the reactor.

Molecular redistribution is discussed in detail in U.S. Pat. No. 6,562,230, which is incorporated by reference herein in its entirety. Molecular redistribution is also described in Robert L. Burnett and Thomas R. Hughes, "Mechanism and Poisoning of the Molecular Redistribution of Alkanes with a Dual-Functional Catalyst System," Journal of Catalysis 31, 55-64 (1973); Thomas R. Hughes, Robert L. Burnett and Robert G. Wall, Proc. International Congress on Catalysis, 5th (Palm Beach, Fla., August 21-25) 1972 paper 87, 1217-1228; and U.S. Pat. Nos. 6,864,398; 6,566,569; 6,441,263; 6,369,286; 6,359,018; 6,225,359; 3,914,330; 3,864,417; 3,856,876; 3,808,285; 3,793,251; 3,784,622; 3,775,505; 3,728,410; 3,718,576; and 3,699,035. These documents are incorporated by reference herein in their entirety.

A brief discussion of molecular redistribution is useful for more clear understanding of the process as described herein. Molecular redistribution uses conventional catalysts, such as $Pt/Al_2O_3$ and $WO_3SiO_2$ (or inexpensive variations) and is typically performed at mild pressures (100-5000 psig). The catalyst has two separate and distinct functions, a dehydrogenation/hydrogenation function and a molecular averaging function. Alternatively, two separate catalysts, one with a dehydrogenation/hydrogenation function and another with a molecular averaging function, may be used. Without wishing to be bound to any particular theory, it is believed that the dehydrogenation/hydrogenation function converts alkanes to olefins and a small amount of hydrogen. The olefins then undergo olefin metathesis due to the molecular averaging function. Olefin metathesis is the redistribution of olefinic (i.e. alkene) bonds by the mechanism of alkene double bond statistical redistribution to a distribution centered around the average molecular weight of the olefins in the feed. Thereafter, the dehydrogenation/hydrogenation function converts the olefins back into alkanes using the small amount of hydrogen produced in the first step.

The dehydrogenation/hydrogenation function within a catalyst mass or the dehydrogenation/hydrogenation catalyst usually will include a Group VIII metal which includes iron, cobalt, nickel, palladium, platinum, rhodium, ruthenium, osmium, and iridium. The molecular averaging function within a catalyst mass or the molecular averaging catalyst will usually include one of more of a metal or the compound of a metal from Group VIB or Group VIIB, which include chromium, manganese, molybdenum, rhenium and tungsten. In most cases, the metals in the catalyst will be supported on a refractory material. Refractory materials are well known in the refining industry and examples include alumina, zirconia, silica, boria, magnesia, titania, and mixtures thereof.

Use of iridium pincer complex catalysts for dehydrogenation and other catalysts for metathesis are described in United States Patent Application Publication 2007/0060781 and Goldman et al., Science, Vol. 312, No. 5771, pp. 257-261, Apr. 14, 2006, which documents are incorporated by reference herein in their entirety.

The presence of the cycloparaffins in the distillate range paraffin feed makes it necessary to complete the mild reformation step prior to the molecular redistribution step. Without wishing to be bound by any particular theory, cycloparaffins apparently readily react in the molecular redistribution reactor and form aromatics and hydrogen. This hydrogen is detrimental to the molecular redistribution process because it inhibits the initial dehydrogenation of the paraffins making it impossible to complete the molecular redistribution process. As an example, even as little as 5 weight percent cyclohexane present in the feed to the molecular redistribution reactor rapidly suppresses the molecular redistribution process.

Any aromatics present in the stream treated in the molecular redistribution reactor are not significantly saturated into alkylcyclohexanes, which would hinder the molecular redistribution process. Rather, the aromatics remain in the moderately aromatic isoparaffinic base oil or low ring content isoparaffinic base oil and improve physical properties of the base oils including additive solubility, engine deposit solubility, and seal compatibility.

Dewaxing

In the base oil production process as described herein, dewaxing is used in conjunction with mild reformation and molecular redistribution. Catalytic dewaxing (e.g. hydroisomerization) and other dewaxing processes are well known in the art. At least a portion of the distributed stream is dewaxed. This stream can be catalytically dewaxed or solvent dewaxed. In some embodiments, the portion of the distributed stream that is dewaxed is both catalytically dewaxed and dewaxed by a process other than catalytic dewaxing, such as solvent dewaxing. Any type of dewaxing process can be used according to the present process. If hydroisomerization is utilized, it may be partial hydroisomerization, complete hydroisomerization (e.g. ISODEWAXING™ process), conventional hydrodewaxing, or distillate hydroisomerization. One embodiment of the process employs both solvent dewaxing and distillate hydroisomerization.

The portion of the distributed stream that is dewaxed includes a bottom portion. Thus, the bottom portion is dewaxed by a process that can be catalytic dewaxing or solvent dewaxing. In some embodiments, a lighter portion of the distributed stream can also be catalytically dewaxed. The lighter portion can be dewaxed with the bottom portion or the lighter portion can be dewaxed separately. When the lighter portion is dewaxed with the bottom portion, the combined stream can be catalytically dewaxed.

Distilling

Once an initial amount of distillate range paraffin feed is mildly reformed and molecularly redistributed to provide the distributed stream, the distillate range paraffin feed can be distilled in a distillation section with the distributed stream and a lighter portion of the dewaxed stream. If such distillation takes places, it produces a distillate range stream including paraffins and cycloparaffins. At this point, the distillate range paraffin feed does not have to directly undergo mild reformation. Instead, the distillate range paraffin feed can be distilled only, while the resulting distillate range stream is subjected to mild reformation.

Recycling the distributed stream and the lighter portion of the dewaxed stream to the distillation section results in a higher yield of moderately aromatic isoparaffinic base oil product or low ring content isoparaffinic base oil product. Hydrocarbons in the distributed stream that have escaped mild reformation and molecular redistribution are resubjected to the process. Similarly, hydrocarbons in the lighter stream that have escaped mild reformation and molecular redistribution as well as dewaxing are resubjected to the process. Eventually, due to the recycling, a majority of the hydrocarbons in the distillate range paraffin feed will submit to mild reforming, molecular redistributing, and dewaxing and transform into the moderately aromatic isoparaffinic base oil product or the low ring content isoparaffinic base oil product.

Integration

The process as described herein is an integrated process comprising mild reformation, molecular redistribution, and dewaxing. The mild reformation, molecular redistribution, and dewaxing steps are not just a sequential series of steps whereby mild reformation occurs first, followed by molecular redistribution, followed by dewaxing. The molecular redistribution and dewaxing steps are interlinked through a recycle stream because at least a portion of the dewaxed product (i.e. the dewaxed stream) is recycled to the molecular redistribution reactor. This recycled portion is generally a lighter portion of the dewaxed stream. However, the recycled portion can also be a wax. Likewise, the mild reformation and molecular redistribution steps may be interlinked by distilling the product of molecular redistribution (i.e. the distributed stream) to produce distillate range hydrocarbons and then mildly reforming the distillate range hydrocarbons.

As a result of integration, the process as described herein is more efficient and effective than a non-integrated process. In particular, integration increases the yield of the moderately aromatic isoparaffinic base oil product or the low ring content base oil product because more hydrocarbons from the distillate range paraffin feed are converted to moderately aromatic isoparaffinic base oil or low ring content isoparaffinic base oil. Without integration, a significant portion of hydrocarbons in the dewaxed stream would escape molecular redistribution and/or dewaxing and a significant portion of hydrocarbons in the distributed stream would escape mild reformation and/or molecular redistribution.

Embodiments

Figure 2:
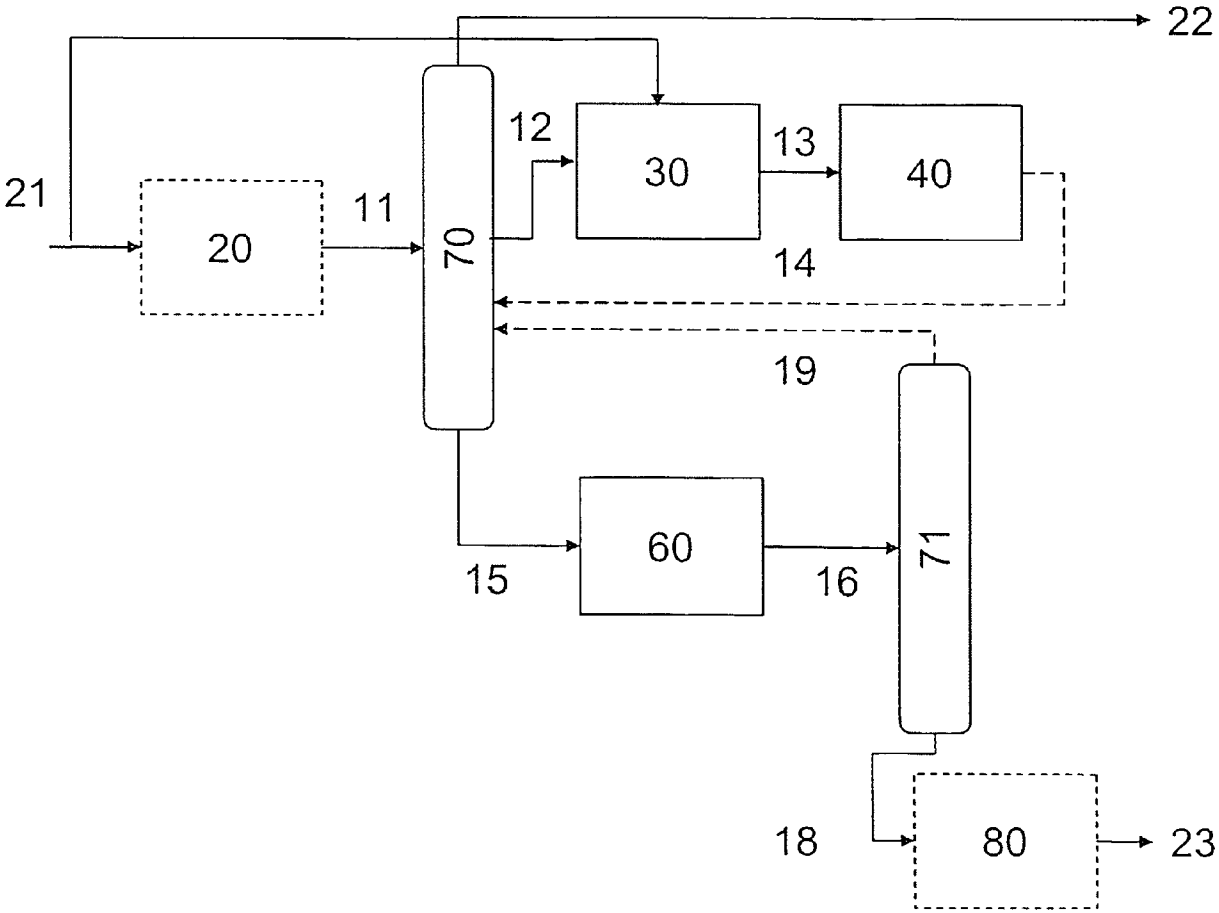
FIG. 2 is a schematic flow diagram representing a first embodiment of the process wherein a distillate range paraffin feed originates from any feasible hydrocarbon source.

FIG. 2 illustrates a first embodiment of the process as described herein. The broadest aspect of the process, shown in FIG. 1, encompasses all of the illustrative embodiments, like the first embodiment.

Referring to FIG. 2, more precisely, a distillate range paraffin feed 21 comprising paraffins and cycloparaffins is initially sent to a mild reformation unit 30, wherein at least some of the cycloparaffins are converted to alkylaromatics to produce a mildly reformed distillate range stream 13. A stream comprising the mildly reformed distillate range stream, which here is simply the mildly reformed distillate range stream 13, is then sent to a molecular redistribution reactor 40, wherein the molecular redistribution process takes place to provide a distributed stream 14. At the same time, the distillate range paraffin feed 21 is also distilled in a first distillation section 70. Three products emanate from the first distillation section 70, a naphtha stream 22, a distillate range stream 12, and a product boiling above the distillate range 15. The naphtha stream 22 is removed from the process, but the distillate range stream 12 and the product boiling above the distillate range 15 remain for subsequent processing. Like the distillate range paraffin feed 21, the distillate range stream 12 includes paraffins and cycloparaffins, at least a portion of which are eliminated in the mild reformation unit 30. The product boiling above the distillate range 15 is sent to a dewaxing unit 60, in which catalytic dewaxing takes place, to provide a dewaxed stream 16. The dewaxed stream 16 is subsequently sent to a second distillation section 71 in order to derive a moderately aromatic isoparaffinic base oil 18 and a lighter material stream 19. Both the lighter material stream 19 and the distributed stream 14 are recycled to the first distillation section 70, where they are distilled with the distillate range paraffin feed 21 to produce more material in the naphtha stream 22, the distillate range stream 12, and the product boiling above the distillate range 15. After there is sufficient material in both the distributed stream 14 and the lighter material stream 19 to sustain the process, the direct feed of the distillate range paraffin feed 21 to the mild reformation unit 30 can be cut off if desired. If this happens, the distillation activity in the first distillation section 70 provides ample hydrocarbons in the distillate range stream 12 to the mild reformation unit 30. Alternatively, fresh hydrocarbons can be fed to the mild reformation unit 30 by means of the distillate range paraffin feed 21 along with hydrocarbons in the distillate range stream 12.

Prior to entering the first distillation section 70, the distillate range paraffin feed 21 is optionally hydrotreated in a first hydrotreater 20 to provide a hydrotreated distillate range paraffin feed 11. Then this hydrotreated distillate range paraffin feed 11 is subjected to distillation in the first distillation section 70 and the process runs its course.

If low ring content isoparaffinic base oil is desired as a product of the process, the moderately aromatic isoparaffinic base oil 18 may be optionally hydrotreated in a second hydrotreater 80 to produce a low ring content isoparaffinic base oil 23.

Figure 3:
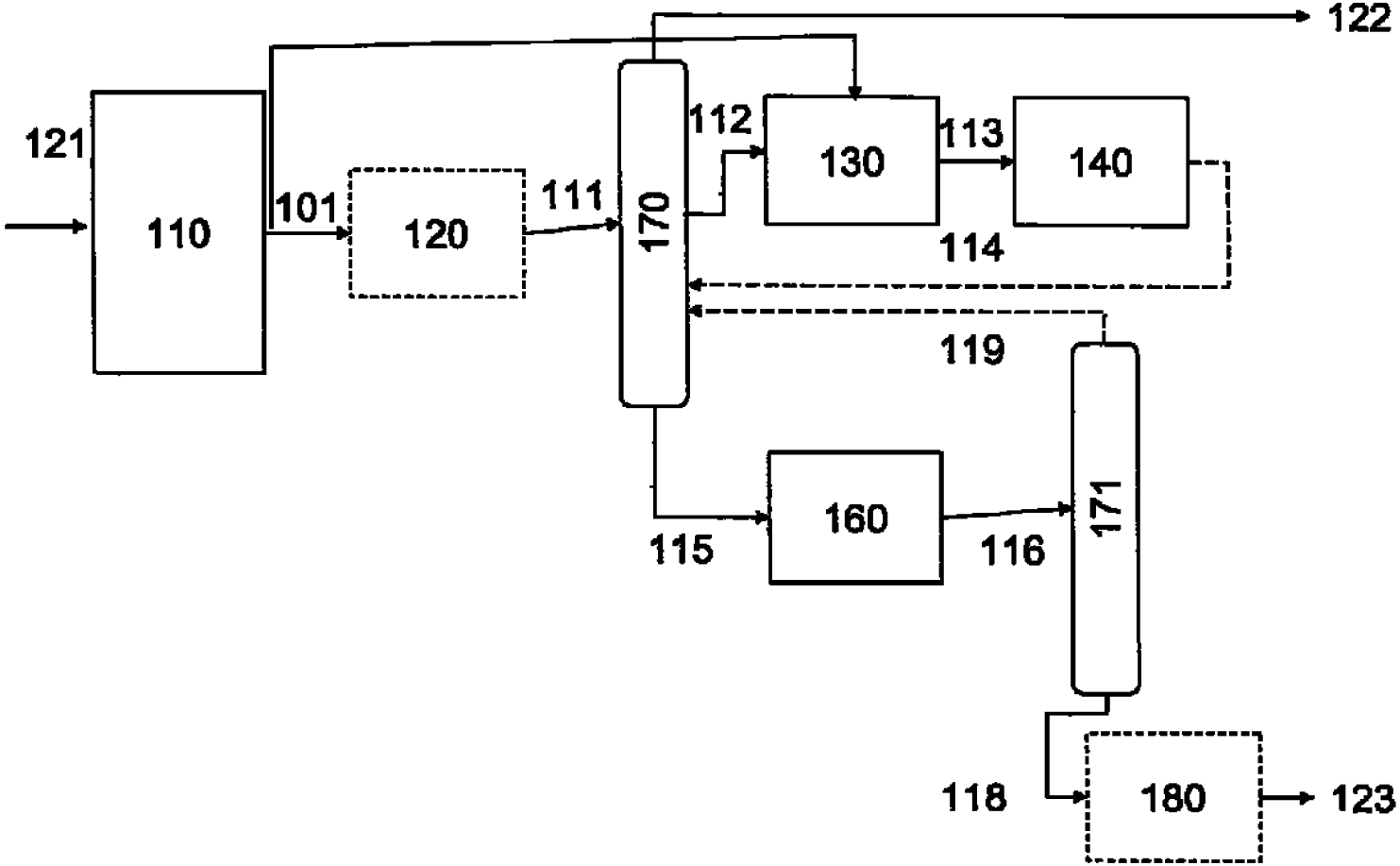
FIG. 3 is a schematic flow diagram representing a second embodiment of the process, which is similar to the first embodiment of the process, yet incorporates a Fischer-Tropsch process such that the distillate range paraffin feed is a Fischer-Tropsch product.

FIG. 3 depicts a second embodiment of the present process. However, FIG. 3 incorporates the process illustrated in FIG. 2. The difference between the process shown in FIG. 2 and the process shown in FIG. 3 is that the distillate range paraffin feed optionally sent to a first hydrotreater 120 is a Fischer-Tropsch product 101. Here, synthesis gas 121 is processed in a Fischer-Tropsch reactor 110 to form the Fischer-Tropsch product 101. In contrast, the distillate range paraffin feedstock 21 of FIG. 2 is derived from a process other than a Fischer-Tropsch process or includes Fischer-Tropsch products along with paraffins derived from processes other than a Fischer-Tropsch process.

Therefore, there are many possible sources of the distillate range paraffin feedstock. It can include Fischer-Tropsch products or paraffins recovered from petroleum, shale oil, or refined products from biological sources. Paraffin recovery methods are known to those of skill in the art and include UOP's MOLEX® or SORBEX® processes described in McPhee, Petroleum Technology Quarterly, pages 127-131, (Winter 1999/2000). An example of a process to generate a paraffinic product from a biological source is described in EP1741767A1.

The second embodiment of FIG. 3 is advantageous as it will produce higher base oil yields because the Fischer-Tropsch product 101 includes material boiling above the distillate range. In FIG. 3, a distillate range paraffin feed 101 comprising paraffins and cycloparaffins is directly sent to a mild reformation unit 130 in order to convert at least a portion of the cycloparaffins to alkylaromatics and provide a mildly reformed distillate range stream 113. Thus, the mildly reformed distillate range stream is free or substantially free of cycloparaffins. Then the mildly reformed distillate range stream 113 is then to a molecular redistribution reactor 140 wherein the molecular redistribution process takes place to provide a distributed stream 114.

The distillate range paraffin feed 101 is also distilled in a first distillation section 170 to provide three streams: a naphtha stream 122, a distillate range stream 112, and product boiling above the distillate range 115. The naphtha stream 122 is removed from the process, but the distillate range stream 112 and the product boiling above the distillate range 115 remain for subsequent processing. Like the distillate range paraffin feed 101, the distillate range stream 112 includes paraffins and cycloparaffins and is processed in the mild reformation unit 130 and the molecular redistribution reactor 140 to provide the distributed stream 14. The product boiling above the distillate range 115 is sent to a dewaxing unit 160, in which catalytic dewaxing takes place, to provide a dewaxed stream 116. The dewaxed stream 16 is subsequently sent to a second distillation section 171 in order to derive a moderately aromatic isoparaffinic base oil 118 and a lighter material stream 119.

Both the distributed stream 14 and the lighter material stream 119 are recycled to the first distillation section 170, where they are distilled with the distillate range paraffin feed 101 to provide more material in the naphtha stream 122, the distillate range stream 112, and the product boiling above the distillate range 115. After there is sufficient material in both the distributed stream 14 and the lighter material stream 19 to provide sufficient hydrocarbons in the distillate range stream 112, the direct feed of the distillate range paraffin feed 101 to the mild reformation unit 130 can be cut off. Alternatively, fresh hydrocarbons can be fed to the mild reformation unit 130 by means of the distillate range paraffin feed 101 along with hydrocarbons in the distillate range stream 112.

According to this embodiment, the distillate range paraffin feed/Fischer-Tropsch product 101 is optionally hydrotreated in a first hydrotreater 120 to provide a hydrotreated distillate range paraffin feed 111. This hydrotreated distillate range paraffin feed 111 then enters the first distillation section 170 along with the distributed stream 114 and the lighter material stream 119.

If a low ring content isoparaffinic base oil is desired, the moderately aromatic isoparaffinic base oil 118 may be optionally hydrotreated in a second hydrotreater 180 to produce a low ring content isoparaffinic base oil 123.

Figure 4:
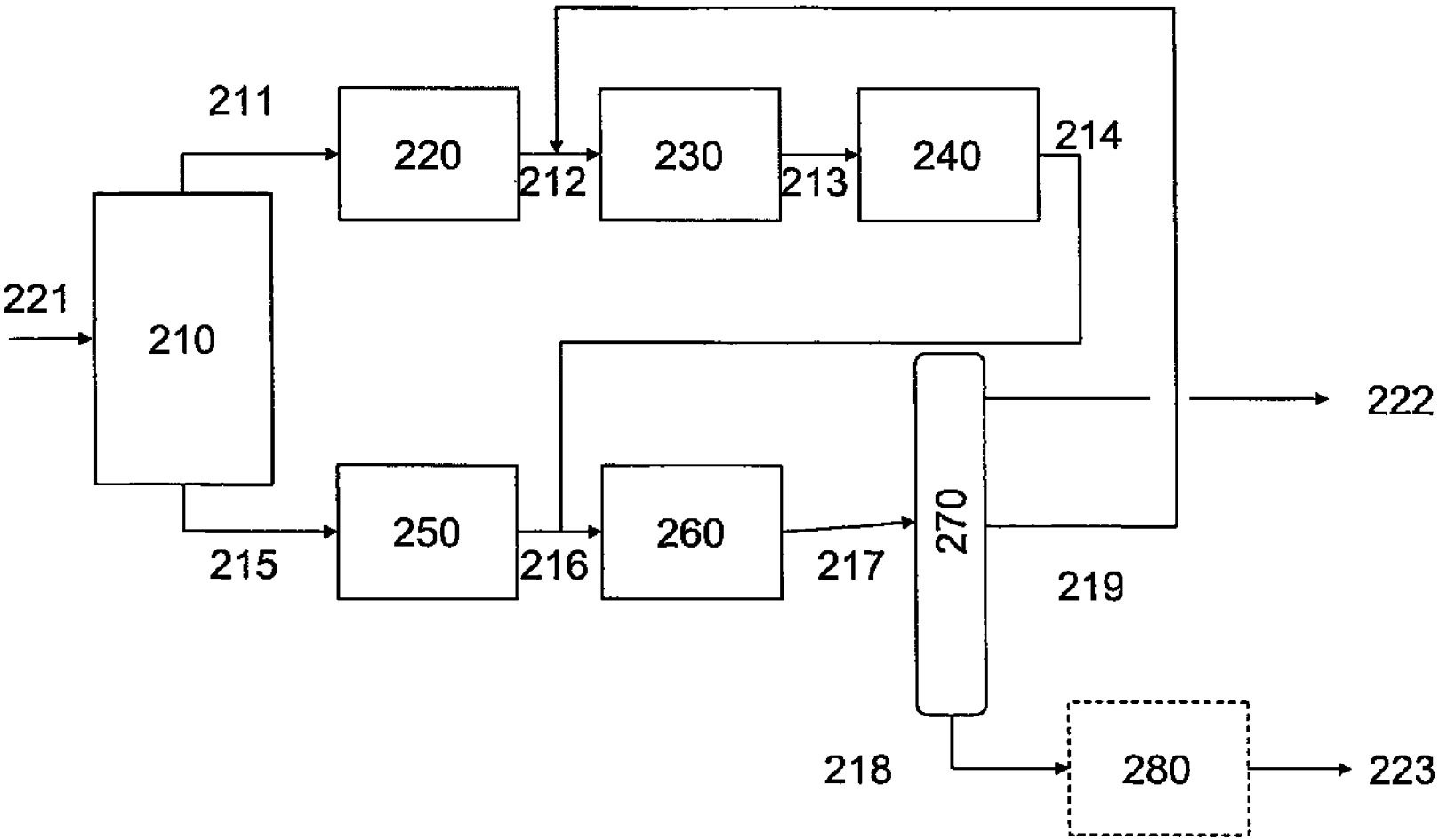
FIG. 4 is a schematic flow diagram representing a third embodiment of the process.

FIG. 4 depicts yet another embodiment, a third embodiment, of the process as described herein. According to this embodiment, synthesis gas 221 is processed in a Fischer-Tropsch reactor 210 to produce a waxy product stream 215 and a distillate range paraffin feed 211. The waxy product stream 215 and the distillate range paraffin feed 211 are both separately hydrotreated in a first hydrotreater 220 and a second hydrotreater 250, respectively. A hydrotreated distillate range paraffin feed 212 and a hydrotreated waxy product stream 216 exit the first hydrotreater 220 and the second hydrotreater 250, respectively. The hydrotreated distillate range paraffin feed 212 enters a mild reformation unit 230 to provide a mildly reformed distillate range stream 213. The mildly reformed distillate range stream 213 is devoid of most or all cycloparaffins because the mild reformation unit 230 converts cycloparaffins to alkylaromatics. Then a stream comprising the mildly reformed distillate range stream, which here is simply the mildly reformed distillate range stream 213 itself, enters a molecular redistribution reactor 240 wherein molecular redistribution occurs. A distributed stream 214 exits the molecular redistribution reactor 240 and is combined with the waxy product stream 216. Thereafter, the combined stream is sent to a dewaxing unit 260, where it is catalytically dewaxed to produce a dewaxed stream 217. After that, the dewaxed stream 217 is separated in a distillation section 270 resulting in a moderately aromatic isoparaffinic base oil 218 and a lighter stream comprising a distillate stream 219 and a naphtha stream 222. While the naphtha stream 222 leaves the process, the distillate stream 219 is recycled to the hydrotreated distillate range paraffin feed 212. Like the hydrotreated distillate range paraffin feed 212, the distillate stream 219 comprises paraffins and cycloparaffins such that the cycloparaffins are converted to alkylaromatics in the mild reformation unit 230.

If a low ring content isoparaffinic base oil is desired, the moderately aromatic isoparaffinic base oil 280 may be hydrotreated in an optional, third hydrotreater 280 to produce a low ring content isoparaffinic base oil 223.

The beneficial aspects of the third embodiment are the separate hydrotreaters 220 and 250. Since the waxy product stream 215 and the distillate range paraffin feed 211 are separately hydrotreated, only one distillation section 270 is necessary and distillation can be better controlled. Like the second embodiment, the third embodiment produces higher yields of base oil because the distillate range paraffin feed 211 and waxy product stream 215 are Fischer-Tropsch products including material boiling above the distillate range.

Figure 5:
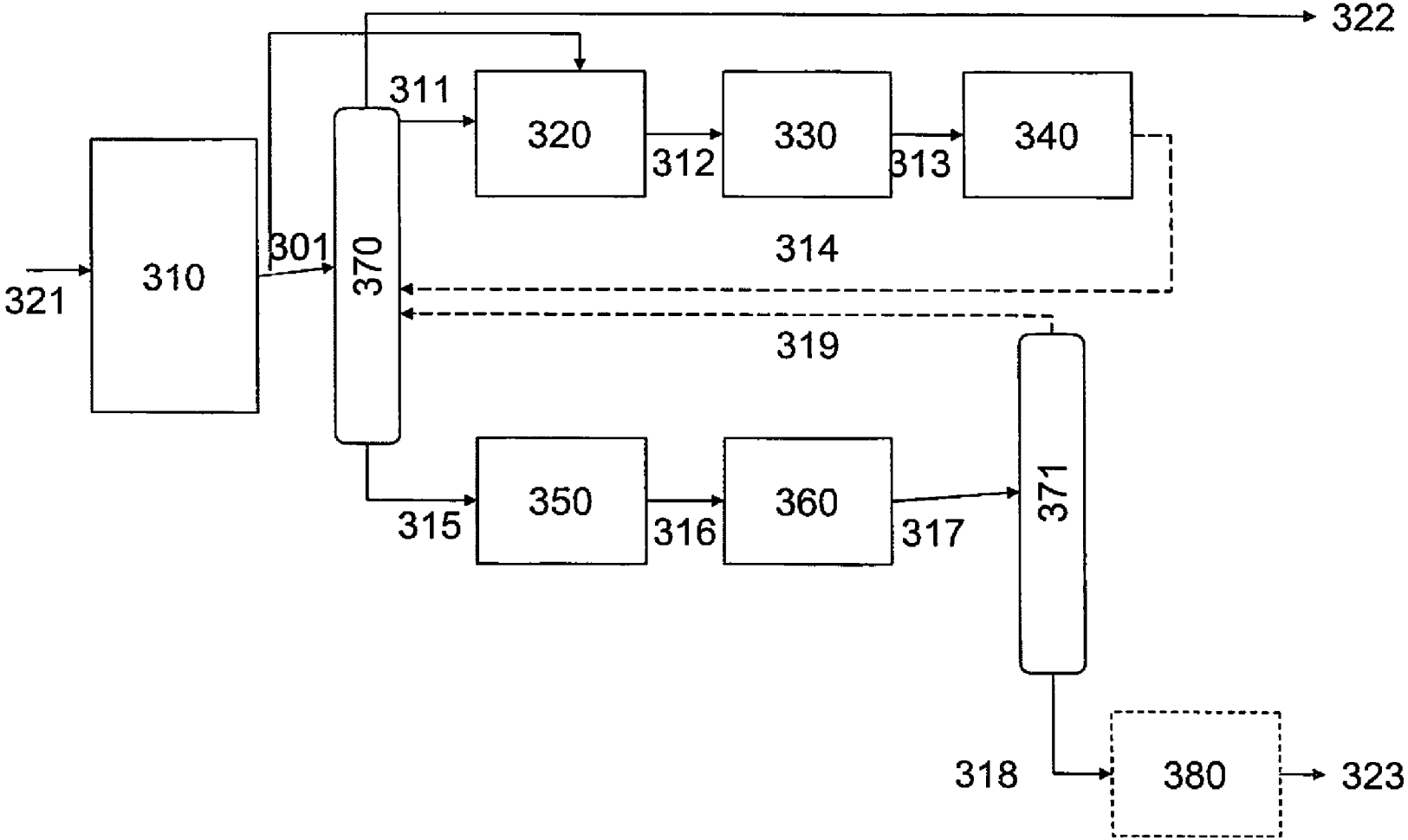
FIG. 5 is a schematic flow diagram representing a fourth embodiment of the process, which is similar to the second embodiment of the process but differs in that a distillate range paraffin feed is hydrotreated prior to being mildly reformed and a stream boiling above the distillate range is hydrotreated prior to being dewaxed.

A fourth embodiment of the process as described herein, shown in FIG. 5, is similar to the first and second embodiments shown in FIGS. 2-3. But the fourth embodiment includes the steps of hydrotreating a distillate range paraffin feed 301, a distillate range stream 311, a stream boiling above the distillate range 315. The distillate range paraffin feed is a Fischer-Tropsch product 301, which is created by treating synthesis gas 321 in a Fischer-Tropsch reactor 310. Here, the distillate range paraffin feed 301 and the distillate range stream 311, both comprising paraffins and cycloparaffins, are first hydrotreated in a first hydrotreater 320 and before being sent to a mild reformation unit 320 to convert at least some of the cycloparaffins to alkylaromatics. A hydrotreated distillate range paraffin feed 312 exits the first hydrotreater 320 and then enters the mild reformation unit 320. A mildly reformed distillate range stream 313 exits the mild reformation unit 330 and enters a molecular redistribution reactor 340 wherein molecular redistribution occurs. A molecularly redistributed product, referred to as a distributed stream 314, exits the molecular redistribution reactor 340.

While the distillate range paraffin feed 301 is sent to the first hydrotreater 320, the distillate range paraffin feed 301 is also distilled in a first distillation section 370 to produce a naphtha stream 322, the distillate range stream 311, and the product boiling above the distillate range 350. The naphtha stream 322 leaves the process. But the product boiling above the distillate range 315. Like the distillate range paraffin feed 301 and the distillate range stream 311, the stream boiling above the distillate range 315 is also hydrotreated in a second hydrotreater 350. A hydrotreated stream boiling above the distillate range 316 exits the second hydrotreater 350 and enters a dewaxing unit 360, wherein catalytic dewaxing takes place, to provide a dewaxed stream 317. The dewaxed stream 317 is then separated into two fractions, the lighter material stream 319 and a moderately aromatic isoparaffinic base oil 318, in a second distillation section 371.

Both the lighter material stream 319 and the distributed stream 314 are recycled to the first distillation section 370 where they are distilled with the distillate range paraffin feed 301 to produce more material in the naphtha stream 322, the distillate range stream 311, and the product boiling above the distillate range 315. Once there is sufficient material in the distributed stream 314 and the lighter material stream 319 so that their distillation with the distillate range paraffin feed 301 produces sufficient material in the distillate range stream 311 and the product boiling above the distillate range 315 to sustain the process, the direct feed of the distillate range paraffin feed 301 to the first hydrotreater 320 can be cut off if desired. Alternatively, the process may continue to send distillate range paraffin feed 301 to the first hydrotreater 320.

The moderately aromatic isoparaffinic base oil 318 may be captured as the ultimate product or, alternatively, the moderately aromatic isoparaffinic base oil 318 may be hydrotreated in an optional third hydrotreater 380 to yield a low ring content isoparaffinic base oil 323.

Benefits of the fourth embodiment include: (1) higher base oil yield due to the fact that the Fischer-Tropsch products include products boiling above the distillate range; (2) better control due to the use of separate hydrotreaters and distillation sections; and (3) a reduction in total flow in the downstream units due to the separation and removal of the naphtha stream.

Figure 6:
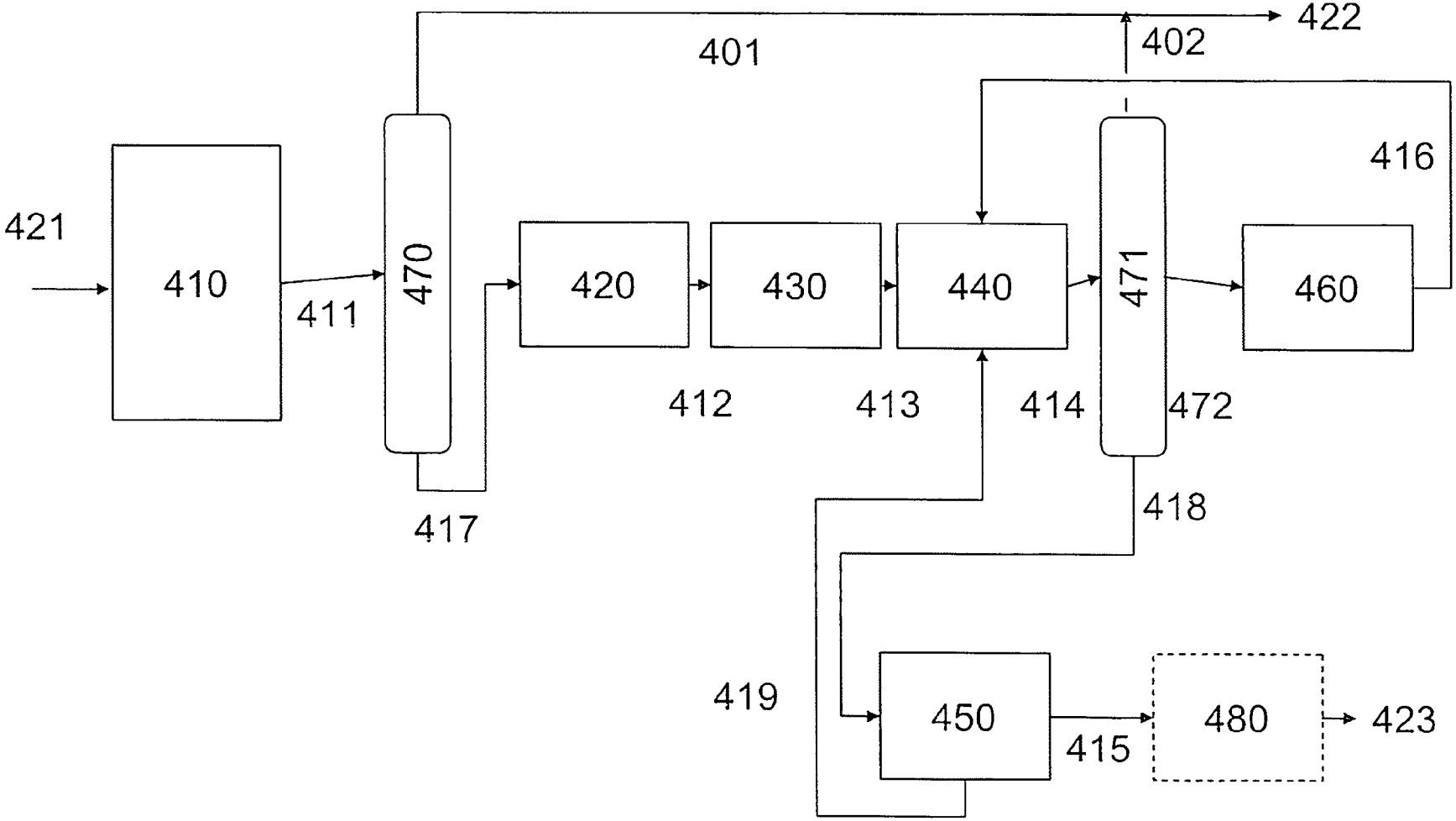
FIG. 6 is a schematic flow diagram representing a fifth embodiment of the process.
Figure 7:
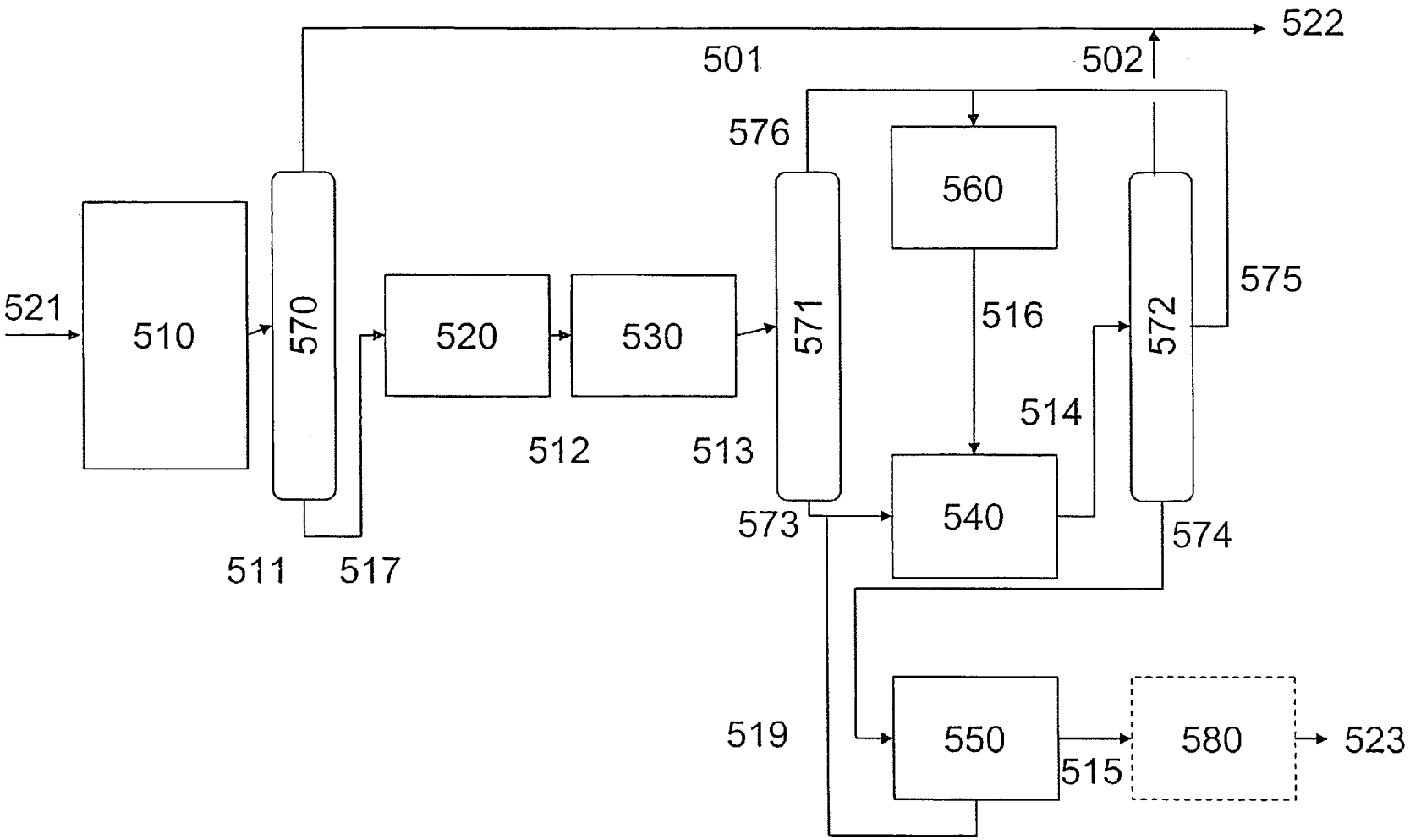
FIG. 7 is a schematic flow diagram representing a sixth embodiment of the process, which is similar to the fifth embodiment of the process, but incorporates extra distilling steps.

The fifth and sixth embodiments of the process, which are depicted in FIGS. 6-7, involve a combination of mild reformation, molecular redistribution, and dewaxing as well. However, the mild reformation process, the molecular redistribution process, and the dewaxing process are arranged in a somewhat different manner, a portion of the dewaxed stream is returned to the molecular redistribution reactor, and a second separation occurs prior to dewaxing, and solvent dewaxing is utilized.

According to the fifth embodiment, synthesis gas 421 is sent to a Fischer-Tropsch reactor 410 to produce Fischer-Tropsch products 411. The Fischer-Tropsch products 411 are then separated in a first distillation section 470 to provide a naphtha stream 401 and a distillate range paraffin feed 417. The distillate range paraffin feed 417 is hydrotreated in a first hydrotreater 420 to provide a hydrotreated distillate range paraffin feed 412, which is subsequently sent to a mild reformation unit 430 where cycloparaffins are converted to alkylaromatics. A mildly reformed distillate range stream 413 exits the mild reformation unit 430. A stream comprising the mildly reformed distillate range stream, more particularly, a combination of the mildly reformed distillate range stream 413, a wax 419 from downstream, and an isoparaffinic stream 416 from downstream next passes through a molecular redistribution reactor 440 to provide a distributed stream 414. The distributed stream 414 is then separated in a second distillation section 471 to provide three streams: a first heavy product stream 418, a first distillate range paraffin stream 472, and another naphtha stream 402. The naphtha streams 401, 402 are removed from the process. FIG. 6 shows that the naphtha streams 401, 402 are combined into a combined naphtha stream 422, which in turn leaves the process. However, the first heavy product stream 418 and first distillate range paraffin stream 472 are subjected to further processing. The first distillate range paraffin stream 472 is hydroisomerized in a distillate hydroisomerization unit 460 to produce an isoparaffinic stream 416, which is then combined into the stream to be processed in the molecular redistribution reactor 440. The heavy product stream 418 is sent to a dewaxing unit 450, wherein solvent dewaxing takes place, to provide the dewaxed stream 415. The dewaxed stream 415 comprises a wax 419, which is also combined into the stream to be processed in the molecular redistribution reactor 440. In this fifth embodiment, the dewaxed stream 415 is the moderately aromatic isoparaffinic base oil. If a low ring content isoparaffinic base oil is desired, the moderately aromatic isoparaffinic base oil may be hydrotreated in an optional second hydrotreater 480 to produce the low ring content isoparaffinic base oil 423.

The fifth embodiment is advantageous for several reasons. First, the fifth embodiment of the process results in a higher base oil yield due to the fact that the Fischer-Tropsch products include products boiling above the distillate range. Second, light products are not formed during the dewaxing process. Third, hydroisomerization of the first distillate range paraffin stream 472 introduces branching into the first heavy product stream 418 conveyed to the dewaxing process. Last, distillate hydroisomerization generally forms fewer light hydrocarbons than dewaxing.

The sixth embodiment of the process, as illustrated in FIG. 7, differs from the fifth embodiment as it utilizes three, rather than two, distillation units. According to the sixth embodiment, synthesis gas 521 is sent to a Fischer-Tropsch reactor to produce Fischer-Tropsch products 511, which are then distilled in a first distillation section 570. A naphtha stream 501 and a distillate range paraffin feed 517 are the products of the first distillation section 570. The distillate range paraffin feed 517 is hydrotreated in a first hydrotreater 520 to provide a hydrotreated distillate range paraffin feed 512, which is subsequently sent to a mild reformation unit 530 wherein cycloparaffins are converted to alkylaromatics. A mildly reformed distillate range stream 513 exits the mild reformation unit 530 and is distilled in a second distillation section 571 into a second heavy product stream 573 and a second distillate range paraffin stream 576. The second heavy product stream 573 is combined into a stream to be processed in a molecular redistribution reactor 540. In this embodiment, the stream to be processed in the molecular redistribution reactor 540 comprises the second heavy product stream 573, a wax 519 from downstream, and an isoparaffinic stream 516 from downstream. A distributed stream 514 exits the molecular redistribution reactor 540 and it is also distilled in a third distillation section 572. Three streams emanate from the third distillation section 572, a first heavy product stream 574, a first distillate range paraffin stream 575, and another naphtha stream 502. The naphtha streams 501, 502 are removed from the process. FIG. 7 shows that the naphtha streams 501, 502 are combined into a combined naphtha stream 522, which in turn leaves the process. However, the first distillate range paraffin stream 576 and the second distillate range paraffin stream 575 are combined into a combined distillate range paraffin stream, which enters a distillate hydroisomerization unit 560. An isoparaffinic stream 516 exits the distillate hydroisomerization unit 560 and is then treated in the molecular redistribution reactor 540 along with the second heavy product stream 573 and the wax 519. The first heavy product stream 574 is treated in a dewaxing unit 550, wherein solvent dewaxing takes place, to provide a dewaxed stream 515. The dewaxed stream 515 comprises the wax 519, which is sent back to the molecular redistribution reactor 540. As in the fifth embodiment, the dewaxed stream 515 is the moderately aromatic isoparaffinic base oil. If a low ring content isoparaffinic base oil is instead desired, the moderately aromatic isoparaffinic base oil 515 can be hydrotreated in an optional second hydrotreater 580 to produce the low ring content isoparaffinic base oil 523.

The sixth embodiment boasts the same advantages as the fifth embodiment. Furthermore, the molecular redistribution reactor can process a heavier feed due to the use of the additional distillation section. This increases the overall yield of the moderately aromatic isoparaffinic base oil 515 and the low ring content isoparaffinic base oil 523.

Although not shown in FIGS. 2-7, a portion of distillate range hydrocarbons may be set aside from the process for further refining in order to produce a distillate product useful, for example, as jet or diesel fuel. Alternatively, the portion of distillate range hydrocarbons dedicated to this optional refining process may be treated in order to produce a distillate blend stock useful for creating a distillate product such as jet or diesel fuel. For example, part of the distillate range stream 12 shown in FIG. 2 may be diverted for this purpose. As another example, part of the distillate stream 219 shown in FIG. 4 may be diverted for this purpose.

EXAMPLES

Example 1

Distillate Range Paraffin Feeds

Four distillate range paraffin feeds were produced by a process involving catalytic dewaxing of hydrotreated Fischer-Tropsch wax followed by hydrofinishing. These distillate range paraffin feeds are listed in Table 1. Various properties of the distillate range paraffin feeds were measured including molecular weight, cycloparaffinic carbon content (Cp), naphthenic carbon content (Cn), aromatic carbon content (Ca), saturated ring carbon content (Cr), etc. The properties of each distillate range paraffin feed are set forth in Table 1.

The molecular weight of each distillate range paraffin feed was measured by ASTM D 2503-92 (Reapproved 2002).

The content of Ca, Cn, and Cr in each distillate range paraffin feed was measured by ASTM D3238-95 with normalization. ASTM D3238-95 is the Standard Test Method for Calculation of Carbon Distribution and Structural Group Analysis of Petroleum Oils by the n-d-M Method and is for "olefin free" hydrocarbons meaning hydrocarbons where the olefin content is 2 weight percent or less. Normalization includes the following steps. If the Ca value is less than zero, Ca is set to zero and Cn and Cp are increased proportionally so that the sum of Ca+Cp+Cn is 100%. If the Cn value is less than zero, Cn is set for zero and Ca and Cp are increased proportionally so that the sum of Ca+Cp+Cn is 100%. If both Cn and Ca are less than zero, Cp is set to 100%. The results for Cp in Table 1 illustrate that low levels of cycloparaffinic carbon can be measured by the normalized n-d-M method.

The olefin content of each distillate range paraffin feed in Table 1 was determined by Proton NMR according to the following procedure. A solution of 5-10% of the distillate range paraffin feed in deuterochloroform was prepared. A normal proton spectrum of at least 12 ppm spectral width was acquired. Tetramethylsilane (TMS) was used as an internal reference standard. The instrument used to acquire the spectrum and reference the chemical shift had sufficient gain range to acquire a signal without overloading the receiver/ADC and had a minimum signal digitization dynamic range of at least 65,000 when a 30 degree pulse was applied. The intensities of the proton signals in the region of 0.5-1.9 ppm (methyl, methylene and methine groups), 1.9-2.2 ppm (allylic) and between 4.5-6.0 ppm (olefin) were measured. Using the average molecular weight (estimated by vapor pressure osmometry) of each distillate range paraffin feed, the following were calculated: (1) the average molecular formula of the saturated hydrocarbons; (2) the average molecular formula of the olefins; (3) the total integral intensity (i.e. the sum of all the integral intensities); and (4) the integral intensity per sample hydrogen (i.e. the total integral intensity divided by the number of hydrogens in the formula); (5) the number of olefin hydrogens (i.e. the olefin integral divided by the integral per hydrogen); (6) the number of double bonds (i.e. the olefin hydrogen multiplied by the hydrogens in the olefin formula divided by 2); and (7) the weight percent olefins (i.e. 100 multiplied by the number of double bonds multiplied by the number of hydrogens in a typical olefin molecule divided by the number of hydrogens in a typical distillate range paraffin feed molecule). This Proton NMR procedure to calculate the olefin content of the distillate range paraffin feeds works best when the olefin content is low, specifically less than about 15 weight percent. Furthermore, the olefins must be conventional olefins meaning a distributed mixture of olefins having hydrogens attached to the double bonded carbons (e.g. alpha, vinylidene, cis, trans, and trisubstituted) because these olefins have a detectable allylic to olefin proton integral ratio between 1 and about 2.5. When the allylic to olefin proton integral ratio exceeds about 3, it indicates that a higher percentage of tri or tetra substituted olefins are present and different assumptions must be made in order to calculate the number of double bonds in the distillate range paraffin feed sample.

TABLE 1

| | Sample/GQ ID | | | |
|---|---|---|---|---|
| | Sample 1 | Sample 2 | Sample 3 | Sample 4 |
| Kinematic Viscosity @ 40° C., cSt | 6.31 | 6.168 | 5.755 | 5.595 |
| Kinematic Viscosity @ 100° C., cSt | 2.032 | 1.991 | 1.900 | 1.875 |
| Viscosity Index | 118 | | | |
| Pour Point, ° C. | −57 | −54 | −54 | −52 |
| n-d-m | | | | |
| Molecular Weight, gm/mol (VPO) | 320 | 308 | 298 | 284 |
| Density, gm/ml | 0.7956 | 0.7950 | 0.7933 | 0.7927 |
| Refractive Index | 1.4453 | 1.4445 | 1.4437 | 1.4435 |
| ndM Parameter v (based on 20 C.) | −0.02 | −0.02 | −0.02 | −0.02 |
| ndm Parameter w (based on 20 C.) | −0.02 | −0.02 | −0.02 | −0.02 |
| Direct ndM calculations (Sulfur taken as zero) | | | | |
| Cp | 99.18 | 97.47 | 97.49 | 96.28 |
| Cn | 2.21 | 4.42 | 4.21 | 4.75 |
| Ca (v negative) | −1.39 | −1.89 | −1.70 | −1.03 |
| Total | 100.00 | 100.00 | 100.00 | 100.00 |
| Cr (w negative) | 0.82 | 2.53 | 2.51 | 3.72 |
| Rn | 0.09 | 0.17 | 0.16 | 0.17 |
| Ra | −0.05 | −0.07 | −0.06 | −0.03 |
| Rt (w negative) | 0.04 | 0.10 | 0.10 | 0.14 |
| Normalized ndM calculations (Ca, Ra = 0) | | | | |
| Cp | 97.82 | 95.67 | 95.86 | 95.30 |
| Cn | 2.18 | 4.33 | 4.14 | 4.70 |
| Ca (v negative) | 0.00 | 0.00 | 0.00 | 0.00 |
| Total | 100.00 | 100.00 | 100.00 | 100.00 |
| Cr (w negative) | 2.18 | 4.33 | 4.14 | 4.70 |
| Rn | 0.09 | 0.17 | 0.16 | 0.17 |
| Ra | 0.00 | 0.00 | 0.00 | 0.00 |
| Rt (w negative) | 0.09 | 0.17 | 0.16 | 0.17 |
| Oxidator BN, hrs | 42.82 | 42.17 | 48.27 | 51.12 |
| Sulfur, ppm | <1 | <1 | <1 | <1 |
| Nitrogen, ppm | <0.1 | <0.1 | <0.1 | <0.1 |
| Noack, wt. % | 81.9 | 81.87 | 83.13 | 82.33 |
| COC Flash Point, ° C. | 168 | 166 | 164 | 170 |
| SIMDIST TBP (WT %), F. | | | | |
| TBP @0.5 | 534 | 534 | 523 | 521 |
| TBP @5 | 588 | 584 | 573 | 568 |
| TBP @10 | 604 | 600 | 588 | 584 |
| TBP @20 | 625 | 621 | 607 | 604 |
| TBP @30 | 640 | 635 | 624 | 620 |
| TBP @40 | 652 | 648 | 636 | 632 |
| TBP @50 | 663 | 658 | 649 | 645 |
| TBP @60 | 672 | 668 | 659 | 656 |
| TBP @70 | 682 | 678 | 670 | 667 |
| TBP @80 | 692 | 688 | 680 | 678 |
| TBP @90 | 702 | 700 | 692 | 690 |
| TBP @95 | 709 | 707 | 699 | 698 |
| TBP @99.5 | 724 | 723 | 715 | 714 |
| NMR | | | | |
| % Olefins by Proton NMR | 0 | 0 | 0 | 0 |

Example 2

Production of Moderately Aromatic Isoparaffinic Base Oil

The following is a prophetic example of producing a moderately aromatic isoparaffinic base oil according to the embodiment of the process depicted in FIG. 2.

A 200-500° F. distillate range paraffin feed is obtained from a paraffinic crude source by processing over a n-paraffin selective adsorbent in the MOLEX™ process. It contains traces of sulfur and nitrogen and has 2 wt % naphthenic carbon as determined by the normalized n-d-M method, which is described in detail in Example 1. The distillate range paraffin feed is hydrotreated over a NiMo/Al2O3 catalyst at 1000 psig, 700° F., and 3 LHSV, 5000 SCFB recycle gas to make a product containing less than 1 ppm sulfur and nitrogen (below detection by standard methods). The hydrotreated product is distilled to give a 200-500° F. product which is sent to a mild reformation unit. This unit operates at 50 psig, 3 LHSV and 800° F., 5000 SCFB recycle gas and converts the 2 wt % naphthenic carbon to 2 wt % aromatic carbon as measured by the normalized n-d-M method.

The catalyst in the mild reformation unit is a 1 wt % Pt/Li-neutralized $Al_2O_3$. It is prepared by dissolving 0.6758 grams of $(NH_3)$,$Pt(NO_3)_2$ (50.01 wt % Pt) and 3.3557 grams $LiNO_3$ in 52.8 grams of water. The solution is impregnated overnight in 67.58 grams of alumina spheres obtained from Condea Chemie (1.7 mm, alumina spheres, 24-42 mesh fraction). The impregnated particles are calcined in air initially at a temperature of 250 degrees F, raised to 700 degrees F. over a period of 5 hours, and held for 8 hours at 700 degrees F. The catalyst is cooled to room temperature within about 5 hours.

The mildly reformed product is sent to a molecular redistribution reactor operated at 650° F., 1 LHSV, 2500 psig with no added $H_2$ or other gas. This reactor uses a 4:1 ratio mixture of two catalysts: the 1 wt % Pt/Li-neutralized $Al_2O_3$ with a $W/SiO_2$ catalyst.

The $W/SiO_2$ catalyst is prepared by dissolving 2.3125 grams of ammonium metatungstate (90.6 wt % $WO_3$) in 36.1 grams of water. The solution is impregnated overnight on 26.4 grams of silica gel manufactured by W.R. Grace/Davison (silica gel grade 59, 24-42 mesh fraction). The resulting impregnated material is calcined in air initially at a temperature of 250 degrees F, raised to 700 degrees F over a period of 5 hours, and held for 8 hours at 700 degrees F. The $W/SiO_2$ catalyst is cooled to room temperature within about 5 hours.

The product from the molecular redistribution reactor is returned to a first distillation column. A light naphtha is removed from the overhead of the column. A waxy bottoms product is withdrawn from the column and sent to a dewaxing unit. This unit uses a 0.25 wt % Pt/Al2O3-bound SSZ-32 zeolite, where the SSZ-32 comprises 50% of the alumina-zeolite mixture. The waxy bottoms product is catalytically hydroisomerized at 750° F., 1000 psig, 5000 SCFB recycle gas, and 1 LHSV to yield a dewaxed product and light by-products. The effluent from the dewaxing unit is sent to a second distillation column where the light by-product is recovered and sent back to the first distillation column. The bottoms from the second distillation column is a moderately aromatic isoparaffinic base oil.

Although the process as described herein has been described in connection with preferred embodiments thereof, it will be appreciated by those skilled in the art that additions, deletions, modifications, and substitutions not specifically described may be made without departing from the spirit and scope of the process as defined in the appended claims.

That which is claimed is:

1. A process for producing a moderately aromatic isoparaffinic base oil from a distillate range product comprising:

(a) providing a distillate range paraffin feed comprising paraffins and cycloparaffins;

(b) mildly reforming the distillate range paraffin feed to convert at least a portion of the cycloparaffins to alkylaromatics and provide a mildly reformed distillate range stream;

(c) treating a stream comprising the mildly reformed distillate range stream in a molecular redistribution reactor to provide a distributed stream;

(d) dewaxing at least a portion of the distributed stream to provide a dewaxed stream;

(e) combining at least a portion of the dewaxed stream with the stream to be processed in the molecular redistribution reactor to provide the distributed stream; and (f) isolating a moderately aromatic isoparaffinic base oil from the dewaxed stream.

2. A process according to claim 1, further comprising distilling the dewaxed stream to separate the moderately aromatic isoparaffinic base oil from a lighter material stream.

3. A process according to claim 2, wherein the lighter material stream comprises a distillate stream and a naphtha stream.

4. A process according to claim 3, further comprising recycling the distillate stream to the distillate range paraffin feed of step (a).

5. A process according to claim 3, further comprising:

providing a waxy product stream;

combining the waxy product stream with at least a portion of the distributed stream to provide a combined stream to be dewaxed; and dewaxing the combined stream in step (d).

6. A process according to claim 5, further comprising hydrotreating the waxy product stream prior to combining the waxy product stream with at least a portion of the distributed stream.

7. A process according to claim 5, wherein the waxy product stream is a Fischer-Tropsch product.

8. A process according to claim 2, further comprising:

optionally hydrotreating the distillate range paraffin feed to provide a hydrotreated distillate range paraffin feed;

distilling the distillate range paraffin feed or the hydrotreated distillate range paraffin feed and the lighter material stream with the distributed stream to provide a stream boiling above the distillate range, a naphtha stream, and a distillate range stream comprising paraffins and cycloparaffins;

dewaxing the stream boiling above the distillate range of the distributed stream in step (d); and mildly reforming the distillate range stream to convert at least a portion of the cycloparaffins to alkylaromatics and provide the mildly reformed distillate range stream of step (b).

9. A process according to claim 8, further comprising hydrotreating the stream boiling above the distillate range of the distributed stream prior to dewaxing.

10. A process according to claim 8, further comprising hydrotreating the distillate range stream prior to mildly reforming the distillate range stream.

11. A process according to claim 1, wherein the cycloparaffins comprise saturated ring carbons and the alkylaromatics comprise aromatic carbons, and the mildly reformed distillate range stream has a percentage of aromatic carbons less than or equal to 5 times a percentage of the saturated ring carbons in the distillate range paraffin feed.

12. A process according to claim 1, wherein the cycloparaffins comprise saturated ring carbons and the alkylaromatics comprise aromatic carbons, and wherein at least a portion of the cycloparaffins have been converted into aromatics, and the mildly reformed distillate range stream has a percentage of aromatic carbons equal to between 10% and 200% of a percentage of the saturated ring carbons in the distillate range paraffin feed.

13. A process according to claim 1, wherein the dewaxed stream further comprises a wax.

14. A process according to claim 13, further comprising combining the wax into the stream to be processed in the molecular redistribution reactor.

15. A process according to claim 1, further comprising:

distilling the distributed stream to provide a first heavy product stream, a first distillate range paraffin stream, and a naphtha stream; and dewaxing the heavy product stream of the distributed stream in step (d).

16. A process according to claim 15, further comprising:

hydroisomerizing the first distillate range paraffin stream to provide an isoparaffinic stream; and combining the isoparaffinic stream into the stream to be processed in the molecular redistribution reactor.

17. A process according to claim 15, further comprising:

distilling the mildly reformed distillate range stream to provide a second heavy product stream and a second distillate range paraffin stream; and combining the second heavy product stream into the stream to be processed in the molecular redistribution reactor.

18. A process according to claim 17, further comprising:

combining the first distillate range paraffin stream with the second distillate range paraffin stream to provide a combined distillate range paraffin stream;

hydroisomerizing the combined distillate range paraffin stream to provide an isoparaffinic stream; and combining the isoparaffinic stream into the stream to be processed in the molecular redistribution reactor.

19. A process according to claim 1, further comprising hydrotreating the moderately aromatic isoparaffinic base oil to provide a low ring content isoparaffinic base oil.

20. A process according to claim 1, wherein the distillate range paraffin feed is a Fischer-Tropsch product.

21. A process according to claim 1, further comprising hydrotreating the distillate range paraffin feed prior to step (b).

22. A process according to claim 1, further comprising distilling the distillate range paraffin feed prior to step (b).

23. A process according to claim 1, wherein the dewaxing step (d) comprises solvent dewaxing and distillate hydroisomerization.

24. A process according to claim 1, wherein the portion of the distributed stream that is dewaxed in step (d) comprises a bottom portion of the distributed stream, and the dewaxing is catalytic.

25. A process according to claim 1, wherein the portion of the distributed stream that is dewaxed in step (d) comprises a bottom portion of the distributed stream and a lighter portion of the distributed stream, and the dewaxing is catalytic.

* * * * *